US006856291B2

(12) United States Patent
Mickle et al.

(10) Patent No.: US 6,856,291 B2
(45) Date of Patent: Feb. 15, 2005

(54) ENERGY HARVESTING CIRCUITS AND ASSOCIATED METHODS

(75) Inventors: Marlin H. Mickle, Pittsburgh, PA (US); Christopher C. Capelli, Kenosha, WI (US); Harold Swift, Gibsonia, PA (US)

(73) Assignee: University of Pittsburgh- Of the Commonwealth System of Higher Education, Pittsburgh, PA (US)

( * ) Notice: Subject to any disclaimer, the term of this patent is extended or adjusted under 35 U.S.C. 154(b) by 0 days.

(21) Appl. No.: 10/624,051

(22) Filed: Jul. 21, 2003

(65) Prior Publication Data

US 2004/0085247 A1 May 6, 2004

Related U.S. Application Data

(60) Provisional application No. 60/403,784, filed on Aug. 15, 2002.

(51) Int. Cl.[7] ..... H01Q 1/26
(52) U.S. Cl. ..... 343/701; 343/703
(58) Field of Search ..... 343/701, 703, 343/722, 741, 850, 860, 866; 340/426, 572; 455/274, 291; 325/373, 374, 3

(56) References Cited

U.S. PATENT DOCUMENTS 3,573,631 A * 4/1971 Carlson ..... 455/195.1
3,665,475 A * 5/1972 Gram ..... 340/825.69
3,953,799 A * 4/1976 Albee ..... 455/291
4,129,125 A 12/1978 Lester et al.
4,166,470 A 9/1979 Neumann
4,308,870 A 1/1982 Arkans
4,356,825 A 11/1982 Veth
4,432,363 A 2/1984 Kakegawa
4,442,434 A * 4/1984 Baekgaard ..... 343/701
4,443,730 A 4/1984 Kitamura et al.
4,494,553 A 1/1985 Sciarra et al.

(List continued on next page.)

OTHER PUBLICATIONS

U.S. Appl. No. 09/951,032, filed Sep. 10, 2001, Mickle et al.
U.S. Appl. No. 60/406,541, filed Aug. 28, 2002, Mickle et al.
U.S. Appl. No. 60/411,825, filed Sep. 18, 2002, Mickle et al.
Craig F. Bohren; "*How can a particle absorb more than the light incident on it*?"; American Journal of Physics; Apr. 1983;pp. 323–327; 51; 4; American Assoc. of Physics Teachers, College Park, Maryland, USA.

(List continued on next page.)

*Primary Examiner*—Tho Phan
(74) *Attorney, Agent, or Firm*—Arnold B. Silverman; Eckert Seamans Cherin & Mellott, LLC

(57) ABSTRACT

An inherently tuned antenna has a circuit for harvesting energy transmitted in space and includes portions that are structured to provide regenerative feedback into the antenna to produce an inherently tuned antenna which has an effective area substantially greater than its physical area. The inherently tuned antenna includes inherent distributive inductive, inherent distributive capacitive and inherent distributive resistive elements which cause the antenna to resonate responsive to receipt of energy at a particular frequency and to provide feedback to regenerate the antenna. The circuit may be provided on an integrated circuit chip. An associated method is provided.

57 Claims, 5 Drawing Sheets

U.S. PATENT DOCUMENTS

| | | | | |
|---|---|---|---|---|
| 4,576,179 | A | | 3/1986 | Manus et al. |
| 4,598,276 | A | | 7/1986 | Tait |
| 4,724,427 | A | | 2/1988 | Carroll |
| 4,857,893 | A | | 8/1989 | Carroll |
| 4,889,131 | A | | 12/1989 | Salem et al. |
| 5,022,402 | A | | 6/1991 | Schieberl et al. |
| 5,111,213 | A | | 5/1992 | Jahoda et al. |
| 5,230,342 | A | | 7/1993 | Bobo, Jr. et al. |
| 5,296,866 | A | | 3/1994 | Sutton |
| 5,335,551 | A | | 8/1994 | Ohnishi et al. |
| 5,387,259 | A | | 2/1995 | Davidson |
| 5,469,180 | A | * | 11/1995 | Wiggenhorn ..... 343/744 |
| 5,586,555 | A | | 12/1996 | Bobo, Jr. et al. |
| 5,613,230 | A | | 3/1997 | Gottfried et al. |
| 5,729,572 | A | | 3/1998 | Oh |
| 5,736,937 | A | | 4/1998 | McGirr et al. |
| 5,760,558 | A | | 6/1998 | Popat |
| 5,768,696 | A | | 6/1998 | Law |
| 5,808,760 | A | | 9/1998 | Gfeller |
| 5,815,807 | A | | 9/1998 | Osmani et al. |
| 5,841,122 | A | | 11/1998 | Kirchhoff |
| 5,844,516 | A | | 12/1998 | Viljanen |
| 5,862,803 | A | | 1/1999 | Besson et al. |
| 5,874,723 | A | | 2/1999 | Hasegawa et al. |
| 5,952,814 | A | | 9/1999 | Van Lerberghe |
| 6,127,799 | A | | 10/2000 | Krishnan |
| 6,141,763 | A | | 10/2000 | Smith et al. |
| 6,284,651 | B1 | | 9/2001 | Sharan et al. |
| 6,289,237 | B1 | | 9/2001 | Mickle et al. |
| 6,310,465 | B2 | | 10/2001 | Najima |
| 6,373,447 | B1 | | 4/2002 | Rostoker et al. |
| 6,411,199 | B1 | | 6/2002 | Geiszler et al. |
| 6,480,699 | B1 | | 11/2002 | Lovoi |
| 6,566,854 | B1 | * | 5/2003 | Hagmann et al. ..... 324/117 R |
| 6,615,074 | B2 | | 9/2003 | Mickle et al. |
| 6,693,584 | B2 | | 2/2004 | Horst et al. |
| 6,703,927 | B2 | * | 3/2004 | Kan ..... 340/426.1 |

OTHER PUBLICATIONS

Ambrose Fleming; *"On Atoms of Action, Electricity, and Light"*; London, Edinburgh and Dublin Philosophical Magazine; 1932; pp. 591–599; V.14, United Kingdom.

R. M. Hornby; *"RFID Solutions for the Express Parcel and Airline Baggage Industry"*; Texas Instruments Limited; Oct. 7, 1999; Texas Instruments, Plano, Texas, USA.

H. Paul and R. Fischer; *"Light absorption by a dipole"*; Sov. Phys. Usp.; Oct. 1983; pp. 923–926; 26; 10; American Institute of Physics, College Park, Maryland, USA.

K. V. S. Rao; *"An Overview of Back Scattered Radio Frequency Identification System (RFID) "*; IEEE; 1999; 0–7803–5761–2/99; Piscataway, New Jersey, USA.

Reinhold Rüdenberg; *"The Reception of Electrical Waves in Wireless Telegraphy"*; Annalen der Physik; 1908; vol. 25; vol. 25; Verlag von Johann Ambrosius Barth, Leipzig, Germany.

N. Saleh and A. H. Quereshi; *"Permalloy Thin–Film Inductors"*; Electronic Letters; Dec. 31, 1970; pp. 850–852; vol. 6; No. 26; IEEE, Piscataway, New Jersey, USA.

R. F. Soohoo; *"Magnetic Thin Film Inductors for Integrated Circuit Applications"*; IEEE Transactions on Magnetics; Nov. 1979; pp. 1803–1805; vol. MAG–15; No. 6; IEEE, Piscataway, New Jersey.

* cited by examiner

ENERGY HARVESTING CIRCUITS AND ASSOCIATED METHODS

CROSS-REFERENCE TO RELATED APPLICATION

This application claims the benefit of U.S. Provisional Application Ser. No. 60/403,784, entitled "ENERGY HARVESTING CIRCUITS AND ASSOCIATED METHODS" filed Aug. 15, 2002.

BACKGROUND OF THE INVENTION

1. Field of the Invention

The present invention relates to an inherently tuned antenna having circuit portions which provide regenerative feedback into the antenna such that the antenna's effective area is substantially greater than its physical area and, more specifically, it provides such circuits which are adapted to be employed in miniaturized form such as on an integrated circuit chip or die. Associated methods are provided.

2. Description of the Prior Art

It has long been known that energy such as RF signals can be transmitted through the air to various types of receiving antennas for a wide range of purposes.

*Rudenberg* in "Der Empfang Elektricscher Wellen in der Drahtlosen Telegraphie" ("The Receipt of Electric Waves in the Wireless Telegraphy") Annalen der Physik IV, 25, 1908, pp. 446–466 disclosed the fact that regeneration through a non-ideal tank circuit with a ¼ wavelength whip antenna can result in an antenna having an effective area larger than its geometric area. He discloses use of the line integral length of the ¼ wavelength whip to achieve the effective area. He stated that the antenna interacts with an incoming field which may be approximately a plane wave causing a current to flow in the antenna by induction. The current, which may be enhanced by regeneration, produces a field in the vicinity of the antenna, with the field interacting with the incoming field in such a way that the incoming field lines are bent. The field lines are bent in such a way that energy is caused to flow from a relatively large portion of the incoming wavefront having the effect of absorbing energy from the wavefront into the antenna from an area of the wavefront which is much larger than the geometric area of the antenna. See also *Fleming* "On Atoms of Action, Electricity, and Light," Philosophical Magazine 14, p. 591 (1932); *Bohren,* "How Can a Particle Absorb More Than the Light Incident On It?", Am. J. Phys. 51, No. 4, p. 323 (1983); and *Paul,* et al., "Light Absorption by a Dipole," Sov. Phys. Usp. 26, No. 10, p. 923 (1983) which elaborate on the teachings of *Rudenberg.* These teachings were all directed to antennas that can be modeled as tuned circuits or mathematically analogous situations encountered in atomic physics.

Regeneration was said to reduce the resistance of the antenna circuit, thereby resulting in increased antenna current and, therefore, increased antenna-field interaction to thereby effect absorption of energy from a larger effective area of the income field. These prior disclosures, while discussing the physical phenomenon, do not teach how to achieve the effect.

U.S. Pat. No. 5,296,866 discloses the use of regeneration in connection with activities in the 1920's involving vacuum tube radio receivers, which consisted of discrete inductor-capacitor tuned circuits coupled to a long-wire antenna and to the grid circuit of a vacuum triode. Some of the energy of the anode circuit was said to be introduced as positive feedback into the grid-antenna circuit. This was said to be like introduction of a negative resistance into the antenna-grid circuit. For example, wind-induced motion of the antenna causing antenna impedance variation were said to be the source of a lack of stability with the circuit going into oscillation responsive thereto. Subsequently, it was suggested that regeneration be applied to a second amplifier stage which was isolated from the antenna circuit by a buffer tube circuit. This was said to reduce spurious signals, but also resulted in substantial reduction of sensitivity. This patent contains additional disclosures of efforts to improve the performance through introduction of negative inductive reactants or resistance with a view toward effecting cancellation of positive electrical characteristics. Stability, however, is not of importance in energy harvesting for conversion to direct current or contemplated by the present invention.

This patent discloses the use of a separate tank circuit, employs discrete inductors, discrete capacitors to increase effective antenna area.

U.S. Pat. No. 5,296,866 also discloses the use of positive feedback in a controlled manner in reducing antenna circuit impedance to thereby reduce instability and achieve an antenna effective area which is said to be larger than results from other configurations. This patent, however, requires the use of discrete circuitry in order to provide positive feedback in a controlled manner. With respect to smaller antennas, the addition of discrete circuit components to provide regeneration increases complexity and costs and, therefore, does not provide an ideal solution, particularly in respect to small, planar antennas on a substrate such as an integrated circuit chip such as a CMOS chip, for example.

There is current interest in developing smaller antennas that can be used in a variety of small electronic end use applications, such as cellular phones, personal pagers, RFID and the like, through the use of planar antennas formed on substrates, such as electronic chips. See generally U.S. Pat. Nos. 4,598,276; 6,373,447; and 4,857,893.

U.S. Pat. No. 4,598,276 discloses an electronic article surveillance system and a marker for use therein. The marker includes a tuned resonant circuit having inductive and capacitive components. The tuned resonant circuit is formed on a laminate of a dielectric with conductive multi-turned spirals on opposing surfaces of the dielectric. The capacitive component is said to be formed as a result of distributive capacitance between opposed spirals. The circuit is said to resonate at least in two predetermined frequencies which are subsequently received to create an output signal. There is no disclosure of the use of regeneration to create a greater effective area for the tuned resonant circuit than the physical area.

U.S. Pat. No. 6,373,447 discloses the use of one or more antennas that are formed on an integrated circuit chip connected to other circuitry on the chip. The antenna configurations include loop, multi-turned loop, square spiral, long wire and dipole. The antenna could have two or more segments which could selectively be connected to one another to alter effective length of the antenna. Also, the two antennas are said to be capable of being formed in two different metalization layers separated by an insulating layer. A major shortcoming of this teaching is that the antenna's transmitting and receiving strength is proportional to the number of turns in the area of the loop. There is no disclosure of regeneration to increase the effective area.

U.S. Pat. No. 4,857,893 discloses the use of planar antennas that are included in circuitry of a transponder on a chip. The planar antenna of the transponder was said to employ magnetic film inductors on the chip in order to allow for a reduction in the number of turns and thereby simplify fabrication of the inductors. It disclosed an antenna having a multi-turned spiral coil and having a 1 cm×1 cm outer diameter. When a high frequency current was passed in the coil, the magnetic films were said to be driven in a hard direction and the two magnetic films around each conductor serve as a magnetic core enclosing a one turn coil. The magnetic films were said to increase the inductance of the coil, in addition to its free-space inductance. The use of a resonant circuit was not disclosed. One of the problems with this approach is the need to fabricate small, air core inductors of sufficiently high inductance and Q for integrated circuit applications. The small air core inductors were said to be made by depositing a permalloy magnetic film or other suitable material having a large magnetic permeability and electric insulating properties in order to increase the inductance of the coil. Such an approach increases the complexity and cost of the antenna on a chip and also limits the ability to reduce the size of the antenna because of the need for the magnetic film layers between the antenna coils.

Co-pending U.S. patent application Ser. No. 09/951,032, which is expressly incorporated herein by reference, discloses an antenna on a chip having an effective area 300 to 400 times greater than its physical area. The effective area is enlarged through the use of an LC tank circuit formed through the distributed inductance and capacitance of a spiral conductor. This is accomplished through the use in the antenna of inter-electrode capacitance and inductance to form the LC tank circuit. This, without requiring the addition of discrete circuitry, provides the antenna with an effective area greater than its physical area. It also eliminates the need to employ magnetic film. As a result, the production of the antenna on an integrated circuit chip is facilitated, as is the design of ultra-small antennas on such chips. See also U.S. Pat. No. 6,289,237, the disclosure of which is expressly incorporated herein by reference.

Despite the foregoing disclosures, there remains a very real and substantial need for circuits useful in receiving and transmitting energy in space, which circuits provide a substantially greater effective area than their physical area. There is a further need for such a system and related methods which facilitate the use of inherently tuned antennas and distributed electrical properties to effect use of antenna regeneration technology in providing such circuits on an integrated circuit chip.

SUMMARY OF THE INVENTION

The present invention has met the above-described needs.

In one embodiment of the invention, an energy harvesting circuit has an inherently tuned antenna, as herein defined, with at least portions of the energy harvesting circuit structured to provide regenerative feedback into the antenna to thereby establish an effective antenna area substantially greater than the physical area. The circuit may employ inherent distributed inductance and inherent distributed capacitance in conjunction with inherent distributed resistance to form a tank circuit which provides the feedback for regeneration. The circuit may be operably associated with a load.

The circuit may be formed as a stand-alone unit and, in another embodiment, may be formed on an integrated circuit chip.

The circuit preferably includes a tank circuit and inherent distributed resistance may be employed to regenerate said antenna. Specific circuitry and means for effecting feedback and regeneration are provided.

The antenna may take the form of a conductive coil on a planar substrate with an opposed surface being a ground plane and inherent distributed impedance, inherent distributed capacitance and inherent distributed resistance.

The energy harvesting circuit may also be employed to transmit energy.

In a related method of energy harvesting, circuitry is employed to provide regenerative feedback and thereby establish an effective antenna area which is substantially greater than the physical area of the antenna.

It is a further object of the present invention to provide such a circuit which may be established by employing printed circuit technology on an appropriate substrate.

It is an object of the present invention to provide unique circuitry which is suited for energy harvesting and transmission of energy, which circuits have a substantially greater effective area than their physical area.

It is another object of the present invention to provide such circuits and related methods that include a tuned resonant circuit and employ inherent distributed inductance, inherent distributive capacitance and inherent distributed resistance in effecting such feedback.

It is a further object of the present invention to provide such a circuit which may be established on an integrated circuit chip or die.

It is another object of the present invention to provide such circuits which do not require the use of discrete capacitors.

It is another object of the present invention to provide such a circuit which takes into consideration the dimensions and conductivity of the antenna's conductive coil, as well as the permitivity of the material that is adjacent to the conductive coil.

It is a further object of the present invention to provide numerous means for creating the desired feedback to establish regeneration into the inherently tuned antenna.

It is a further object of the present invention to provide such circuits which can advantageously be employed with RF energy which is transported through space and received by the energy harvesting circuitry.

It is yet another object of the invention to provide an RF energy harvesting circuit wherein the effective energy harvesting area of the antenna is greater than and independent of the physical area of the antenna.

These and other objects of the invention will be more fully understood from the following description of the invention with reference to the drawings appended hereto.

DESCRIPTION OF THE PREFERRED EMBODIMENTS

As employed herein, the term "inherently tuned antenna" means an electrically conductive article in conjunction with its surrounding material, including, but not limited to, the on-chip circuitry, conductors, semiconductors, interconnects and vias functioning as an antenna and has inherent electrical properties of inductance, capacitance and resistance where the collective inductance and capacitance can be combined to resonate at a desired frequency responsive to exogenous energy being applied thereto and provide regenerative feedback to the antenna to thereby establish an effective antenna area greater than its physical area. The antenna may be a stand-alone antenna or may be integrated with an integrated circuit chip or die, with or without additional electrical elements and employ the total inductance, capacitance and resistance of all such elements.

As employed herein, the term "effective area" means the area of a transmitted wave front whose power can be converted to a useful purpose.

As employed herein, the term "energy harvesting" shall refer to an antenna or circuit that receives energy in space and captures a portion of the same for purposes of collection or accumulation and conversion for immediate or subsequent use.

As employed herein, the terms "in space" or "through space" mean that energy or signals are being transmitted through the air or similar medium regardless of whether the transmission is within or partially within an enclosure, as contrasted with transmission of electrical energy by a hard wire or printed circuits boards.

Figure 1:
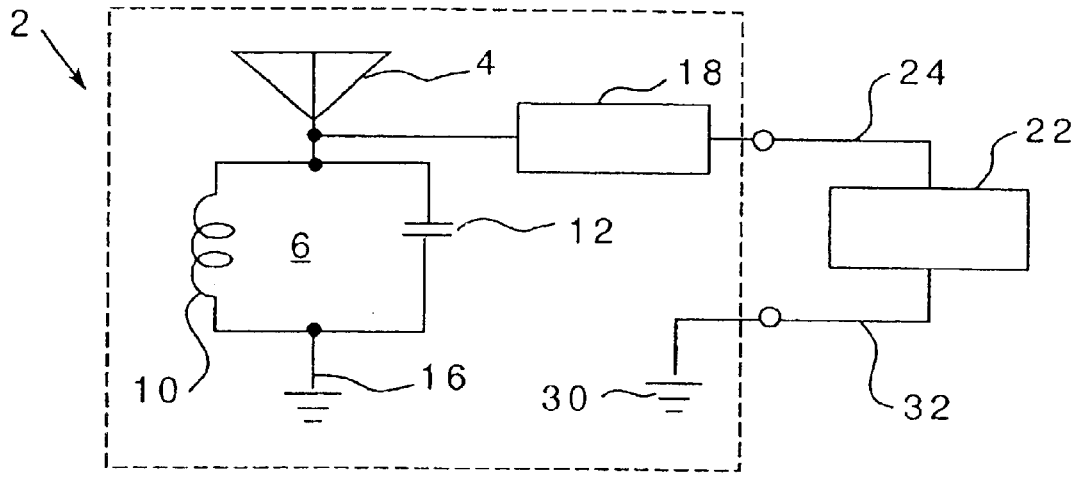
FIG. 1 is a schematic illustration of a harvesting equivalent circuit of the present invention shown under ideal conditions.

Referring to the inherently tuned antenna 2 of the equivalent circuit of FIG. 1 (shown in the dashed box), there is shown an antenna element 4, a tank circuit 6, including an inductor 10 and capacitor 12, as well as a ground 16. Any lumped impedance 18 is also shown. The load 22 is electrically connected to the lumped impedance through lead 24 and to ground 30 through lead 32. This energy harvesting circuit is adapted to be employed efficiently with RF energy received through space, as herein defined. The circuit 2 may be provided on an integrated circuit wafer having whatever additional circuit components are desired. The distributed self and parasitic resistance, inductance and capacitance provide an effective solid three-dimensional integrated circuit. Parasitic capacitances are the non-negligible capacitive effects due to the proximity of the antenna conductor to the other circuit elements or potential conductors, semiconductors, interconnects or vias providing distributed capacitance or capacitance effects and the corresponding proximal effect due to the small size of the device or die.

A second or alternate source of regeneration is due to the standing wave reflections resulting from the mismatch of the impedance of load 22 and the equivalent impedance 18 of the antenna circuits.

The tank circuit 6 of FIG. 1 resonates at a particular frequency which is determined through design by the distributed inductance 10 and distributed capacitance 12. In the ideal case, the tank circuit 6 would, at resonance, represent an infinite impedance with energy from the antenna being fed to lumped impedance 18. The distributed resistance does, in fact, cause the antenna receiving the energy from the remote source to transmit energy due to the voltage (energy) presented to the antenna as a result of the tank circuit 6 and antenna resistance combination.

The circuit of FIG. 1 has the property of presenting a regenerative "antenna" to the RF medium. This results in the circuit providing an antenna effective area that is substantially greater than its physical area and may, for example, be many times greater than the physical area. This is accomplished through feedback or regeneration into the inherently tuned antenna. This regenerative source is the direct result of the non-ideal fabrication of the tank circuit in the confined space of a CMOS chip, for example. The relative close proximity of the chip components provides inductance 10 and capacitance 12 with the inherent resistance of the conductive element. The conductive element is the metallic element forming the ideal antenna element 4 of FIG. 1.

Various preferred means of establishing the feedback for regeneration are contemplated by the present invention. Among the presently preferred approaches are creating a controlled mismatch in impedance between the output equivalent impedance 18 in the circuit 2 and the load 22. The regenerative source caused by the mismatch is represented by reference number 36 in FIG. 2 as an element of an equivalent circuit.

Referring again to FIG. 1, wherein an embodiment having the resonance, in addition to the tank circuit 6, feeding a certain amount of energy to the antenna 4 feeds some energy to the load 22 connected to circuit 2. There may be a mismatch in impedance between the output equivalent circuit of circuit 2 and the load 22. This mismatch will result in energy reflected to circuit 2, wherein due to the high tank impedance due to resonance, the energy will cause additional transmission by the antenna 4. The regenerative action of the antenna circuit 2 of FIG. 1 causes energy to be retransmitted by the antenna circuit 2, thereby further increasing the effective area. The regenerative action of the antenna 4 by either the voltage drop across the tank circuit 6 or the reflection from the load 22 will cause a transmitted near field to exist in the area of the antenna 4. The near field then causes the antenna to have an effective area substantially larger than the physical area. This may, for example, be in the order of about 1,000 to 2,000 times the actual physical area of the conductor forming the antenna for tank circuit 6 combination.

Another approach would be the sharing of power generated by the antenna. The power output by the circuit 2 will have some value P. By intentional mismatch, a portion of this power $\forall P$ may be caused to reflect into the circuit 2. The balance of the power $(1-\forall)$ P 62 would be delivered to the load 22. Under ideal matching conditions, $\forall=0$ and P is delivered to the load. Although not functionally useful, $\forall=1$ implies no power is delivered to the load. The choice of a value of 0.∴∀.∴1 will provide a maximum of power to be delivered to the load 22 by increasing the effective area to some optimum value.

In the classical antenna theory with a matched load only one half of the power available can be delivered to the load. In the current context, P is the value of power delivered to the load or one half of the total power available. Yet another approach would be through the inductance into the antenna coil.

The present invention may achieve the desired resonant tank circuit (LC) through the use of the inherent distributed inductance and inherent distributed capacitance of the conducting antenna elements. The desired frequency is a function of the LC product. As the conductor elements become thinner, it may be desirable to accommodate reduced capacitance for a fixed LC value through increased inductance. This may be accomplished by adding additional conductors between the antenna conducting elements. These additional elements may be single function conductors or one or more additional antennas.

Figure 2:
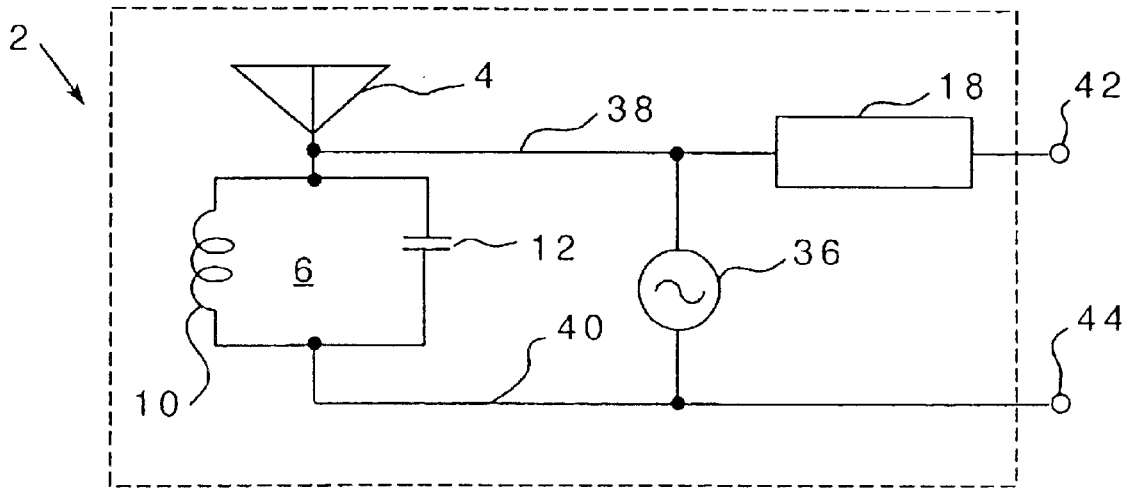
FIG. 2 is a schematic illustration of another harvesting equivalent circuit of the present invention accounting for regenerative transmission due to source/load impedance mismatch.

Referring to FIG. 2, there is shown a modified form of circuit 2', wherein the mismatch reflection is shown as a regenerative source 36. It is shown as connected between lead 38 and lead 40 with circuit electrical contacts 42, 44 being present.

Figure 3:
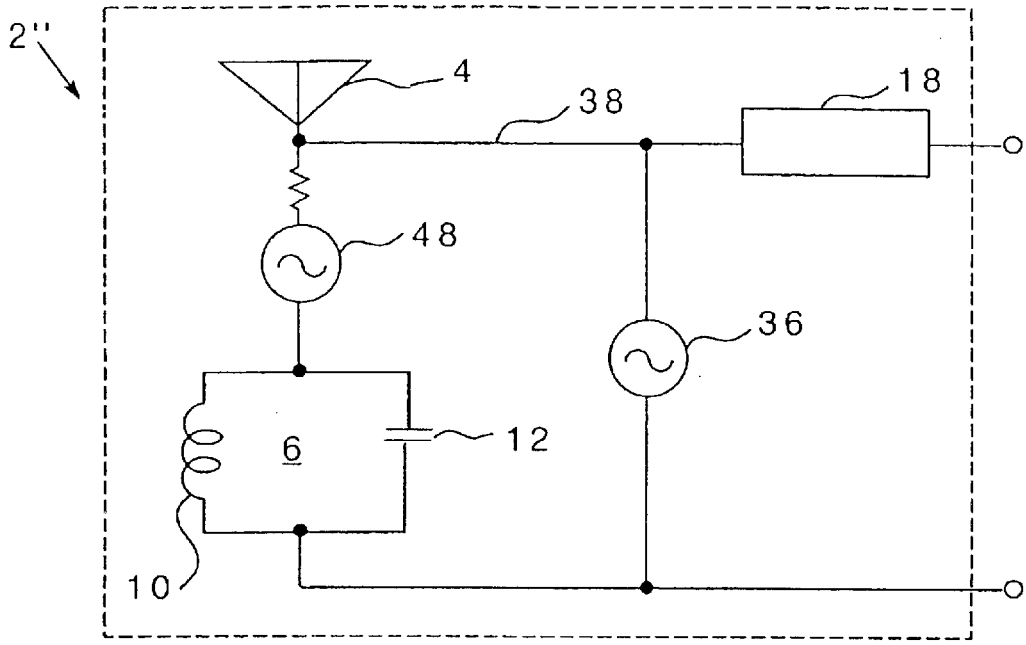
FIG. 3 is a schematic illustration of another equivalent circuit of the present invention extending FIG. 2 to include regeneration due to a non-ideal tank circuit.

Referring to FIG. 3, there is shown a lumped linear model for an RF frequency energy harvest circuit, a modified circuit 2" having antenna 4, tank circuit 6 which is related to the voltage drop across tank circuit 6. In addition to regenerative source 36, there is shown regenerative source 48. This source 48 serves to represent a regenerative source that is a non-ideal tank circuit. Both regeneration sources 36, 48 cooperate to increase the regenerative effect on the effective area.

Figure 4:
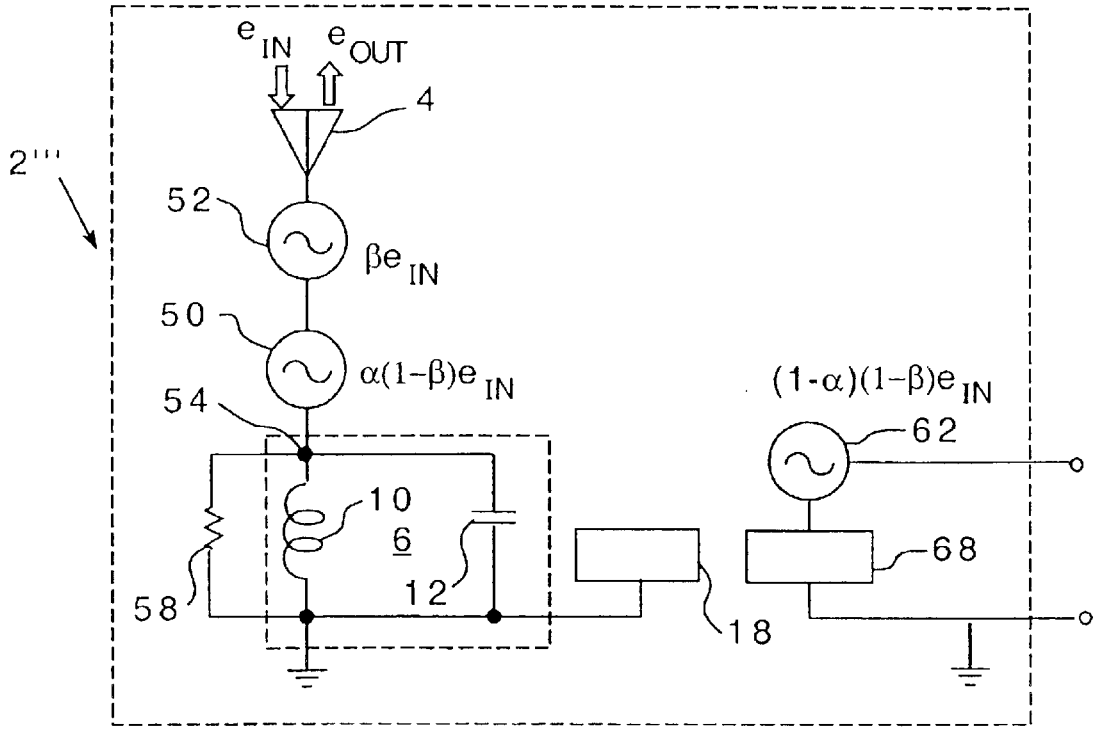
FIG. 4 is a schematic illustration of an alternate equivalent circuit of the present invention separating the mismatch regenerative source from the actual source power delivered to the load.

Referring to FIG. 4, there is shown a modified energy harvesting circuit 2''' wherein the regenerative sources 50, 52 represent, respectively, the regenerative sources 36, 48 which include quantification of the regenerative sources 36, 48 in terms of the incoming ($e_{IN}$) and parameters ∀ and ∃ so as to provide the non-ideal effect in mathematical form that is both consistent with the ideal tank circuit and an ideal matching of the source. Impedance and load impedance point 54 is representative of the voltage at the LC tank 6. The expression $e_{IN}$ is the amount of energy produced by the physical area of the antenna.

There is also shown resistance 58 in FIG. 4 to account for the resistance which produces the non-ideal properties. Shown to the right of effective impedance 18 and regenerative source 50, are source 62 and impedance 68 that represent, respectively, the non-reflected energy 62 and the equivalent impedance of the source 68 as seen by the load.

In the circuit of FIG. 4, two parameters, ∀ and ∃, are introduced to identify that portion of energy that is retransmitted by the antenna due to: (1) the resistance of the nonideal tank circuit, ∃, and (2) the reflected energy from a mismatched load connected to the output terminals, ∀.

In general, ∀ and ∃ may be complex functions whose specific values can be obtained empirically under a specified set of conditions.

As a means of illustration, without any loss to generality, the harvested energy due to the physical area will be noted as a voltage, $e_{IN}$, to facilitate the discussion using the equivalent RFEH circuit of FIG. 4. The relationship of $e_{IN}$ to power and energy is simply through a proportional relationship.

The parameter, ∀, represents that part of $e_{IN}$ that is lost through radiation due to the non-ideal tank of FIG. 4. From an energy conservation standpoint, 0[∀[1.

The parameter, ∃, represents that part of the load energy that is reflected due to impedance mismatch between the impedance of the load and the out impedance of FIG. 4. From a conservation standpoint, 0[∃[1.

The term "$e_{OUT}$" refers to the total energy of regeneration that causes the increase in effective area.

It will be appreciated that the antennas employed in the present circuit are tuned without the need for employing discrete capacitors. The L, C and R elements of FIGS. 1–4 are all distributed elements resulting from the conductor forming the antenna 4. The tuned resonant circuit is created using the antenna's inherent distributed inductance L and inherent distributive capacitance C which form a tank circuit. This tuned circuit is designed by taking into consideration the dimensions and conductivity of the antenna's conductive coil and the permitivity of the material that surrounds the conductive coil. The effects of other conductors and potentials form parasitic distributed elements contributing to the L, C and R 10, 12, 58, respectively.

Figure 5A:
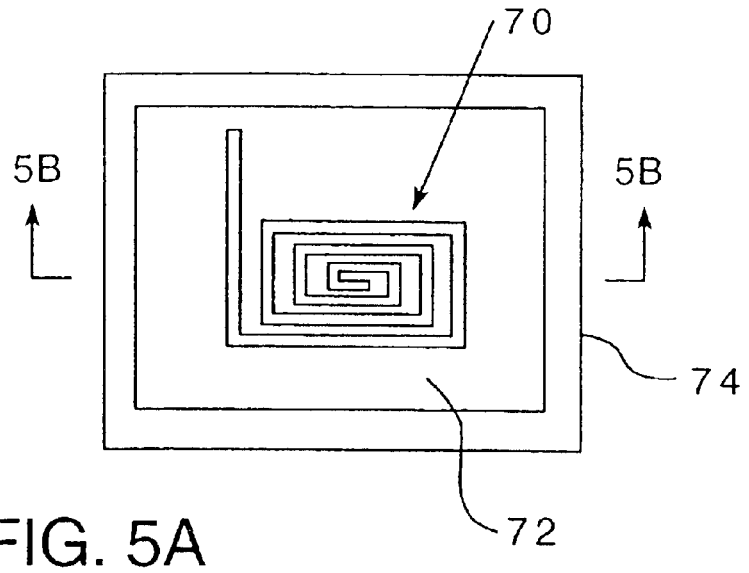
FIG. 5A is a schematic illustration in plan of an energy harvesting circuit of the present invention showing a square coil.
Figure 5B:
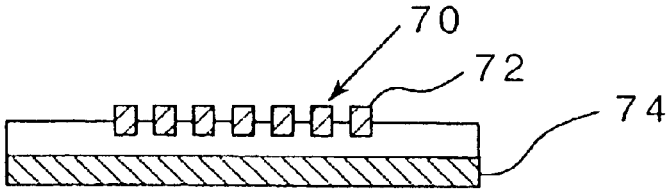
FIG. 5B is a cross-sectional illustration of the energy harvesting circuit of FIG. 5A taken through 5B 5B of FIG. 5A.

Referring to FIGS. 5A and 5B, there is shown in plan in FIG. 5A a square coil antenna 70 which is mounted on a dielectric substrate 72 which, in turn, has an underlying ground plane 74. In the form shown the generally helical antenna 70 has right angled turns and is shown in section in FIG. 5B. The coil itself has a length preferably that is ¼ of the wavelength of the energy powering the radio frequency (RF) source, a trace thickness and a trace width, wherein the trace width is substantially greater than the thickness. Also, the substrate 72 has a surface area much greater than its thickness and is made of a material of high dielectric constant. The tuning of the antenna 70 is based upon the distributed inductance L and distributed capacitance C. The frequency of the antenna is generally inversely proportional to the square root of the product of inductance L and capacitance C.

Figure 6:
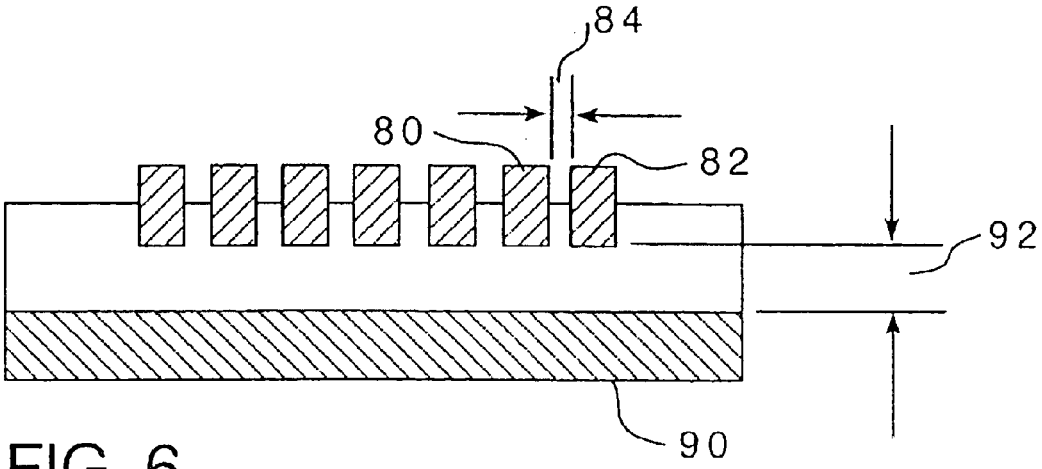
FIG. 6 is a cross-sectional illustration of an energy harvesting circuit of the present invention.

Referring to FIG. 6 and the distributed capacitance in the antenna, it will be seen that two regions of distributed capacitance will be considered. A first form of distributed capacitance is formed between the conductive traces of the antenna 70 such as between portions 80 and 82 which have a gap 84 therebetween. Further distributed capacitance exists between the conductive electrode traces, such as segments 80, 82, for example, and the ground plane 90 as illustrated by the gap 92. The total distributed capacitance may, therefore, be determined by multiplying the conductive area of the electrode by the dielectric constant of the substrate 72 and dividing this quantity by the spacing 92 between the conductive electrode 80, 82, for example, and the substrate ground 90. To this is added the conductive area of the electrode 70 as multiplied by the dielectric constant of the substrate 72 and dividing by the interelectrode spacing 84. In general, the parasitic capacitance between the spiral antenna's conductive traces, such as 80, 82, and the substrate ground 90 will be greater than the parasitic capacitance between the conductive traces such as through spacing 84. This creates enhanced design flexibility in respect of spiral antennas.

For example, if one wishes to reduce the size of the antenna while maintaining the same response frequency, one may reduce the width of the metal trace. In so doing, the parasitic capacitance between the antenna's conductive traces 80, 82 and the grounded substrate 90 will be reduced by the reduction in size of the conductive trace. This reduction may be compensated for in any of a number of ways, such as, for example, by altering the design of the antenna's spiral conductive traces, depositing a higher dielectric material between the conductive traces, or altering the permitivity of the substrate material 74. As the traces are placed closer together, the distributed capacitance between the conductors, such as 80, 82, is increased.

It will be appreciated from the foregoing that the invention relates to a circuit and related methods for energy harvesting and, if desired, retransmitting. It consists of a tuned resonant circuit formed by a conductor 4 and inherent means for regeneration of the tuned resonant circuit wherein the circuit has an effective area that is substantially greater than the physical area. The energy transmitted through space, which may be air, acts as a medium and produces a wavefront that can be characterized by watts per unit area or joules per unit area. With an antenna, one may harvest or collect the energy and convert it to a form that is usable for a variety of electronic, mechanical or other devices to form particular functions, such as sensing, for example, or simple identification of an object in the space of the wavefront. When the energy is used as it is collected and converted, it is more convenient to consider the "power" available in space. If the "energy" is collected over a period of time before it is used, it is more convenient to consider the energy available in space. For convenience of reference herein, however, both of these categories will be referred to as "energy harvesting."

EXAMPLE 1

It will be appreciated that the invention is suited for use with extremely small circuits which may be provided on integrated circuit chips. Assuming, for example, energy harvesting at a radio frequency (RF) of 915 MHz, the effective area of an antenna normally does not get smaller than $k \times 8^2$ with k being less than or equal to 1 that is a wavelength of the given frequency (8) on a side. For example, if the antenna is a typical half-wave dipole, the effective area is not much smaller than $8^2$. At 915 MHz, the wavelength 8 is approximately 12.908 inches and, as a result, the k $8^2$ of a half-wave dipole for energy harvesting would be 21.66 square inches with k equal to 0.13. The half-wave characterization implies something about the dimensions of the antenna. However, the physical dimension of the antenna employable advantageously with the present invention would be substantially less than 21.66 square inches.

As a second example, a quarter-wave "whip" antenna having an effective area of 0.5, that of a half-wave dipole, will have an effective area that is a linear function of the gain, in which case the k for the effective area is approximately 0.065. Based upon this, the effective area should be 0.065 $8^2$ or 10.83 inches squared.

Figure 7A:
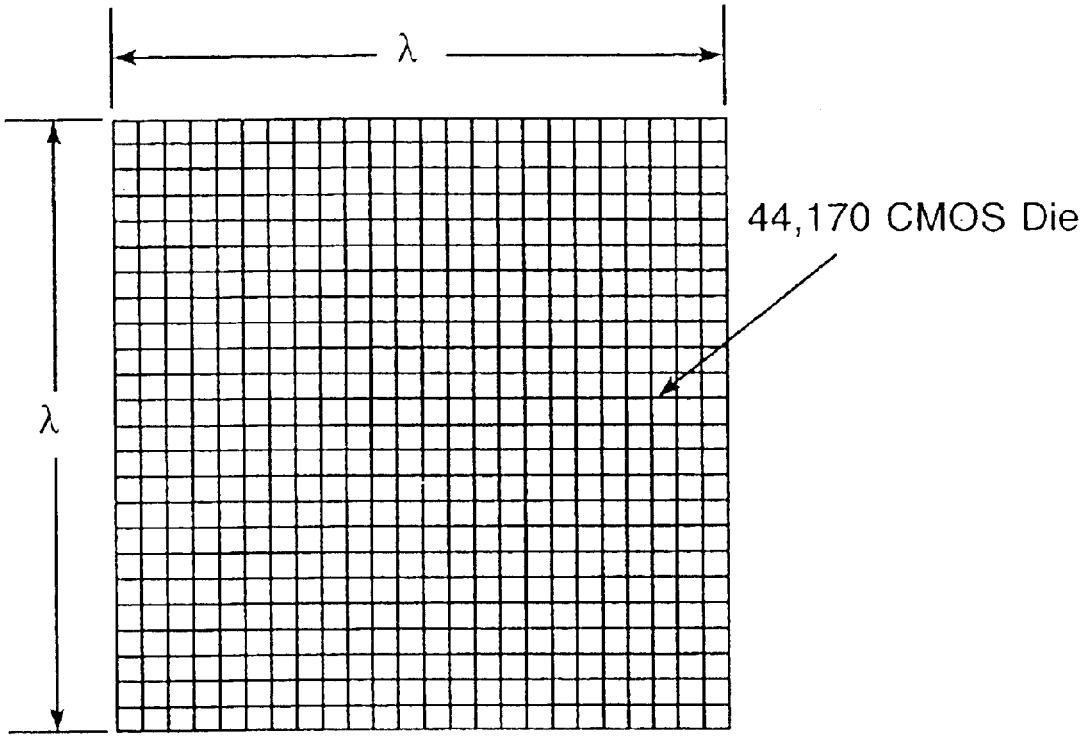
FIG. 7A is a schematic illustration of a square having a dimension of one wavelength and containing a large number of CMOS chips or dies.
Figure 7B:
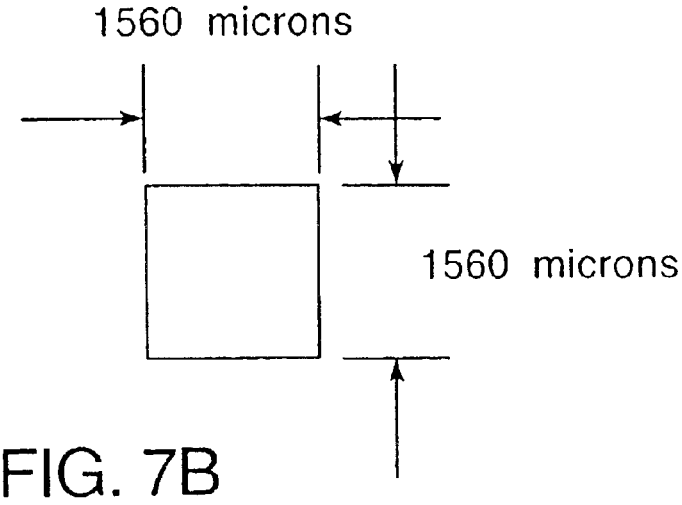
FIG. 7B is a schematic illustration of a single CMOS die or chip as related to FIG. 7A.

Considering a square spiral antenna of a length of approximately 3.073 inches, wherein the spiral is formed within a square of 1560 microns, as a matter of perspective, a fabricated Complimentary Metal Oxide Semiconductor (CMOS) die can be of the same dimensions of the square spiral. It would, therefore, be possible to fit 44,170 such dies in the square of one wavelength. This situation is illustrated in FIGS. 7A and 7B, wherein 7A shows a square having a dimension of 8 and 7B shows a single chip or die having a dimension of 1560 microns. This establishes a relationship between a properly designed antenna having energy harvesting capability and the die or chip size harvesting the same amount of energy as the traditional antenna, such as a half-wave dipole. The square of one wavelength may be chosen as a measure for a basis of efficiency determinations and will be referred to herein as $S_{QE}$.

EXAMPLE 2

In order to provide a further comparison, one may consider a test antenna which is 1560 micron square in a planar antenna on a CMOS chip as the test antenna. The antenna was designed to provide a full conductive path over a quarter of a cycle of a 915 MHz current, i.e., a quarter of a wavelength. The test antenna employed in the experiments had a square spiral of a length of approximately 3.073 inches, wherein the spiral is formed within a square of 1560 microns. As a result, the length of the conductor is one quarter wavelength, but it does not appear as the traditional quarter wave whip antenna. The 1560 micron dimension establishes a physical antenna area microns is 0.061417 inches, thereby providing a physical area of the spiral antenna of 0.00377209 inches.

In establishing the square spiral, the material employed was made up of a conductive coil of aluminum with a square resistance of 0.03 ohms. The conductive coil was put on the substrate as part of the AMI_ABN_1.5:CMOS process. The electrode and inter-electrode dimensions were the electrode trace 13.6 microns and the inter-electrode space 19.2 microns, with the substrate being a p-type silicon. The dimensions of the substrate was 2.2 microns square and approximately 0.3 microns thick. The die was bonded to a printed circuit board that was placed on four brass SMA RF connectors. The electrical circuit fed by this array was a discrete charge pump (voltage doubler) that was placed in series with a similar antenna/circuit with a resulting combination feeding two light emitting diodes connected in parallel. This test antenna, for purposes of feedback or regeneration, served as a comparison basis for the control antenna.

The "control antenna" was selected to provide a physical area equal to the effective area. As a result, the energy harvested would be merely the product of the power density times the effective area which equals the physical area. The test antenna may be considered to be the antenna illustrated in FIG. 5A. The area of the square spiral having outer dimension of 1560 microns by 1560 microns is 2,433,600 microns square. Alternatively, the physical area may be considered the metallic conductor, which, in this case, would result in a physical area of 1,063,223 micros square. The test antenna of the type shown in the FIG. 5A was placed in an RF field of 915 MHz at a distance of 8 feet from the transmitting antenna. The power from the transmitter was approximately 6 watts and the antenna directive gain was approximately 6. The total surface area of the sphere at 8 feet for the isotropic case was $4 \times 3.14 \times .R^2 = 4 \times 3.14 \times 8^2 = 804.25$ $feet^2$. The gain of the powering antenna in the most favorable direction is approximately 6, giving the power density in the most favorable direction as power density=[6×6 watts/804.25 $feet^2$]=0.0447622 watts/$feet^2$. Assuming the 1560 microns square as the physical area, the physical area of the test antenna is 0.0000262 $feet^2$. Therefore, the amount of energy that should be harvested according to classical definitions would be 0.0447622 watts/$feet^2$×0.0000262 $feet^2$=1.17277 microwatts. The spiral antennas of the dimensions cited were placed in the field of the indicated RF transmitter and antenna. The power area intercepted simply by the area of the antenna would be expected to be 1.17277 microwatts, based solely on power density and physical antenna size for the control antenna, i.e., watts per square inch or watts per die area. In this case, physical size was assumed to be the total area of the square spiral.

Two such antennas drove a load of 2.50 milliwatts after any losses between the antennas and the actual load that was driven. The power delivered to the load was 2.50 milliwatts, giving a power of 1.25 milliwatts provided by each antenna. As a result, it was possible to harvest power through an effective area to physical area ratio of ($1.25\times10^{-3}$ watts)/($1.17255\times10^{-6}$ watts)=1,066. As a result, the effective area of the antenna was equal to 0.0000262 feet$^2$×1,066=0.0279292 feet$^2$. These results show that for the test antenna, the measured power was 1.25 m watts with an effective area of 1,066 $S_{QE}$ and that the control antenna, the measured power was 1.17255: watts with the effective area 1 $S_{QE}$. Therefore, the test antenna had an effective area equal to the geometric area of 1,066 dies and the conceptual control antenna had an effective area equivalent to the geometric area of 1.0 die. The prime difference between the two antennas was the use in the test antenna of inherently tuned circuit and means to provide feedback for regeneration in to the inherently tuned circuit.

It will be appreciated that numerous methods of manufacturing the circuits of the present invention may be employed. For example, semiconductor production techniques that efficiently create a single monolithic chip assembly that includes all of the desired circuitry for a functionally complete regenerative antenna circuit within the present invention may be employed. The chip, for example, may be in the form of a device selected from a CMOS device and a MEMS device.

Figure 8:
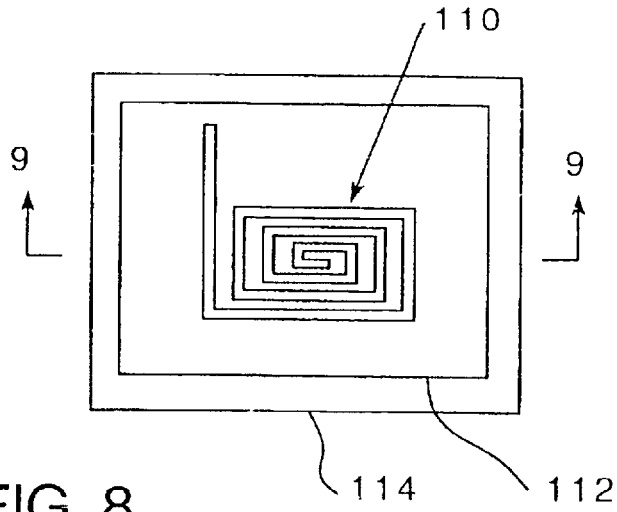
FIG. 8 is a plan view of a form of regenerating antenna on an integral chip or die.
Figure 9:
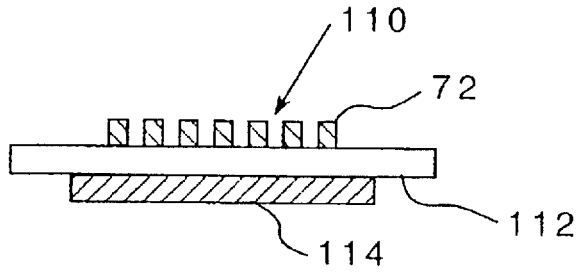
FIG. 9 is a cross-sectional illustration taken through 9—9 of FIG. 8.

Another method of producing the harvesting circuits of the present invention is through printing of the components of the circuit, such as the antenna. A printed antenna that has an effective area greater than its physical area is shown in FIGS. 8 and 9. This construction can be created by designing the antenna such as the coil shown in FIGS. 8 and 9 and designated by number 110 with specific electrode and inter-electrode dimensions so that when printed on a grounded substrate, the desired antenna square coil and LC tank circuit will be provided. The substrate 112 and ground 114 may be of the type previously described hereinbefore. The nonconductive substrate 112 may be any suitable dielectric such as a resinous plastic film or glass, for example. The substrate 112 has grounded plane 114 disposed on the opposite side thereof. Among the known suitable conductive compositions for use in coil 110 are conductive epoxy and conductive ink, for example. The printing technique may be standard printing, such as ink-jet or silk screen, for example. The printed antenna, used in conjunction with the circuit, provides the desired regeneration of the present circuitry. Other electronic components that are desired above and beyond the antenna and the components disclosed herein, such as, for example, diodes, can also be provided by printing onto the substrate 112 in order to form a printed charge device of the present invention.

While prime focus has been placed herein on energy harvesting, it will be appreciated that the present invention may also be employed to transmit energy. The functioning electronic circuit for which the energy is being harvested has in general a need to communicate with a remote device through the medium. Such communication will possibly require an RF antenna. The antenna will be located on the silicon chip thereby being subject to like parasitic effects. However, such a transmitting antenna may or may not be designed to perform as an energy harvesting antenna.

It will be appreciated that the present invention, particularly with respect to miniaturized use as in or on integrated circuit chips or dies, may find wide application in numerous areas of use, such as, for example, cellular telephones, RFID applications, televisions, personal pagers, electronic cameras, battery rechargers, sensors, medical devices, telecommunication equipment, military equipment, optoelectronics and transportation.

Figure 10:
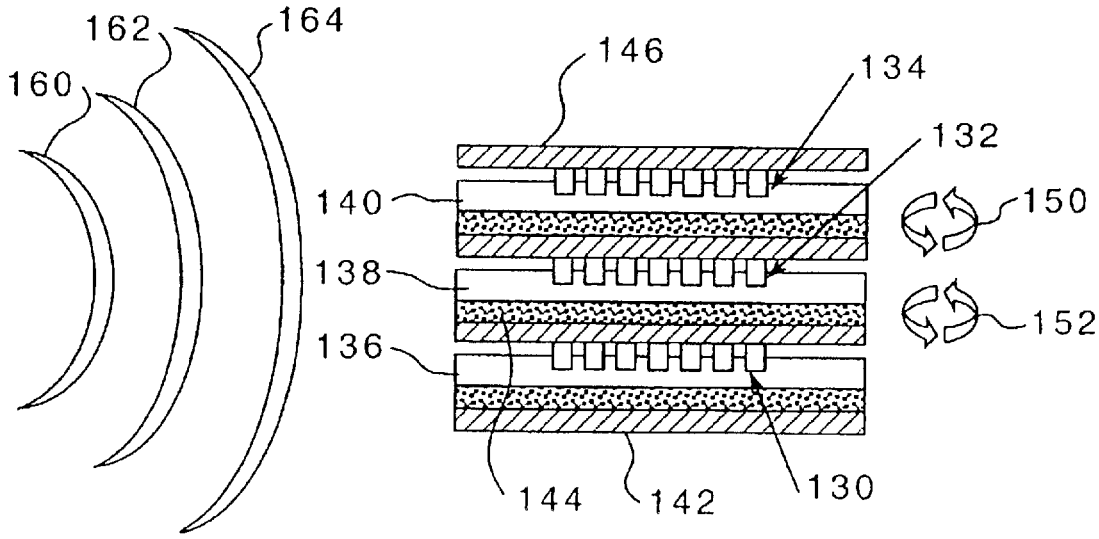
FIG. 10 is a schematic embodiment of the present invention showing a plurality of inherently tuned antennas within a single product unit.

FIG. 10 shows, a plurality of antennas with each on a suitable substrate, such as antennas 130, 132, 134 with an appropriate dielectric substrate such as 136, 138, 140 and a ground plane 142, 144, 146 providing an effective means of harvesting energy delivered through space. In this embodiment, the regeneration not only enlarges the effective antenna area with respect to the geometric or physical area due to regeneration through the tank circuit, but also through inductance 150, 152 between the antennas in the regenerative antenna stack. The energy field approaching the antennas 130, 132, 134 in space has been indicated generally by the reference numbers 160, 162, 164 and may be in the RF field of 915 MHz. Each antenna would harvest energy resulting in current flow in each antenna. The current flow in turn would produce a magnetic field which can cause an increase in current through induction in the adjacent antenna in the regenerative antenna stack. This increase in current flow causes increased antenna field interaction resulting in absorption of energy from an even larger effective area of the incoming field than were the individual antennas to be employed alone.

It will be appreciated, therefore, that the present invention provides an efficient circuit and associated method for circuitry for harvesting energy and transmitting energy that consists of a tuned resonant circuit and inherent means for regeneration of the tuned resonant circuit, wherein the circuit is provided with an effective area greater than its physical area. The tuned resonant circuit is preferably created by an inherent distributed inductance and inherent distributed capacitance that forms a tank circuit. The tuned circuit is structured to provide the desired feedback for regeneration, thereby creating an effective area substantially greater than the physical area. Unlike certain prior art teachings, there is no requirement that a discrete inductor or discrete capacitor be employed as tuned circuit components. Also, multiple circuits may be employed in cooperation with each other through the stacking embodiment, such as illustrated in FIG. 10.

Whereas particular embodiments have been described herein for purposes of illustration, it will be evident to those skilled in the art that numerous variations of the details may be made without departing from the invention as defined in the appended claims.

What is claimed is:

1. An energy harvesting circuit comprising an inherently tuned antenna, and at least portions of said inherently tuned antenna structured to employ inherent distributed induction and inherent distributed capacitance to form a tank circuit to provide regenerative feedback into said antenna, whereby said inherently tuned antenna will have an effective area substantially greater than its physical area.

2. The energy harvesting circuit of claim 1, including said circuit being structured to produce said regenerative feedback through at least one of the group consisting of (a) a mismatch in impedance, (b) a showing of power generated by said inherently tuned antenna, (c) inductance, and (d) reflections due to said mismatch of impedance.

3. The energy harvesting circuit of claim 2, including said circuit does not require discrete capacitors.

4. The energy harvesting circuit of claim 1, including said antenna is an electrically conductive coil having predetermined width, height and conductivity.

5. The energy harvesting circuit of claim 4, including a material of predetermined permitivity disposed adjacent to said conductive coil.

6. The energy harvesting circuit of claim 4, including said conductive coil being a planar antenna, a substrate in which said conductive coil is constructed on one surface and a ground plane on an opposite surface, and said antenna having inherent distributed inductance and inherent distributed capacitance forming a tank circuit and inherent distributed resistance structured to regenerate said antenna.

7. The energy harvesting circuit of claim 6, including said circuit is structured to provide at least a substantial portion of said inherent distributed capacitance between said conductive coil and said ground plane.

8. The energy harvesting circuit of claim 6, including said circuit is structured to provide at least a substantial portion of said inherent distributed capacitance between segments of said conductive coil.

9. The energy harvesting circuit of claim 6, including said circuit is structured to provide a portion of said inherent distributed capacitance between said conductive coil and said ground substrate, and a portion of said inherent distributed capacitance between segments of said conductive coil.

10. The energy harvesting circuit of claim 1, including said circuit is structured to provide said regenerative feedback through a mismatch in impedance.

11. The energy harvesting circuit of claim 10, including said circuit is structured to provide feedback due to standard wave reflection due to said mismatch in impedance.

12. The energy harvesting circuit of claim 1, including said circuit is structured to provide said regenerative feedback through sharing of power generated by said inherently tuned antenna.

13. The energy harvesting circuit of claim 1, including said circuit is structured to provide said regenerative feedback through inductance.

14. The energy harvesting circuit of claim 1, including said circuit is a stand-alone circuit.

15. The energy harvesting circuit of claim 1, including said circuit is formed on an integrated circuit electronic chip.

16. The energy harvesting circuit of claim 1, including said inherently tuned antenna having an effective area greater than said antenna's physical area by about 1000 to 2000.

17. The energy harvesting circuit of claim 1, including said tank circuit structured to regenerate said inherently tuned antenna.

18. The energy harvesting circuit of claim 1, including said circuit being structured to receive RF energy.

19. The energy harvesting circuit of claim 1, including said circuit having inherent distributed resistance which contributes to said feedback.

20. The energy harvesting circuit of claim 19, including said circuit structure to employ parasitic capacitances.

21. An energy harvesting circuit comprising a plurality of inherently tuned antennas with each said antenna having portions structured to provide regenerative feedback into the said antenna, each said inherently tuned antenna having a said circuit that employs inherent distributed inductance and inherent distributed capacitance to form a tank circuit, whereby said inherently tuned antennas will each have an effective area substantially greater than their respective physical areas.

22. The energy harvesting circuit of claim 21, including said circuit being structured to produce said regenerative feedback through at least one of the group consisting of (a) a mismatch in impedance, (b) a sharing of power generated by said inherently tuned antenna, (c) inductance, and (d) reflections due to said mismatch of impedance.

23. The energy harvesting circuit of claim 22, including each said inherently tuned antenna having a circuit not requiring discrete capacitors.

24. The energy harvesting circuit of claim 22, including each said inherently tuned antenna having a tank circuit and an inherent resistance structured to regenerate said inherently tuned antenna.

25. The energy harvesting circuit of claim 21, including each said inherently tuned antenna having an electrically conductive coil having predetermined width, height and conductivity.

26. The energy harvesting circuit of claim 25, including each said inherently tuned antenna having a material of predetermined permitivity disposed adjacent to said conductive coil.

27. The energy harvesting circuit of claim 25, including each said inherently tuned antenna having a conductive coil being a planar antenna, a substrate in which said conductive coil is constructed on one surface and a ground plane on an opposite surface, and said antenna having inherent distributed inductance and inherent distributed capacitance forming a tank circuit and inherent resistance structured to regenerate said antenna.

28. The energy harvesting circuit of claim 27, including each said inherently tuned antenna having a circuit that is structured to provide at least a substantial portion of said inherent distributed capacitance between said conductive coil and said ground plane.

29. The energy harvesting circuit of claim 27, including each said inherently tuned antenna having a circuit that is structured to provide at least a substantial portion of said inherent distributed capacitance between segments of said conductive coil.

30. The energy harvesting circuit of claim 27, including each said inherently tuned antenna having a circuit that is structured to provide a portion of said inherent distributed capacitance between said conductive coil and said ground substrate, and a portion of said inherent distributed capacitance between segments of said conductive coil.

31. The energy harvesting circuit of claim 21, including each said inherently tuned antenna having a circuit that is structured to provide said regenerative feedback through a mismatch in impedance.

32. The energy harvesting circuit of claim 31, including said circuit is structured to provide feedback due to standing wave reflection due to said mismatch in impedance.

33. The energy harvesting circuit of claim 21, including each said inherently tuned antenna having a circuit that is structured to provide said regenerative feedback through sharing of power generated by said inherently tuned antenna.

34. The energy harvesting circuit of claim 21, including each said inherently tuned antenna having a circuit that is structured to provide said regenerative feedback through inductance.

35. The energy harvesting circuit of claim 21, including each said inherently tuned antenna having a circuit that is a stand-alone circuit.

36. The energy harvesting circuit of claim 21, including each said inherently tuned antenna having a circuit that is formed on an integrated circuit electronic chip.

37. The energy harvesting circuit of claim 21, including each said inherently tuned antenna having an inherently tuned antenna having an effective area greater than said antenna's physical area by about 1000 to 2000.

38. The energy harvesting circuit of claim 21, including said circuit being structured to receive RF energy.

39. The energy harvesting circuit of claim 21, including said circuit having inherent distributed resistance which contributes to said feedback.

40. A method of energy harvesting comprising providing an inherently tuned antenna, and providing at least portions of said antenna structured to provide regenerative feedback into said antenna such that said inherently tuned antenna will have an effective area substantially greater than its physical area, employing in said circuit inherent distributed inductance and inherent distributed capacitance to form a tank circuit, delivering energy to said inherently tuned antenna through space, and providing a portion of the energy output of said inherently tuned antenna as regenerative feedback to said inherently tuned antenna to thereby establish in said antenna said effective area substantially greater than said physical area.

41. The method of energy recovery of claim 40, including said circuit being structured to produce said regenerative feedback through at least one of the group consisting of (a) a mismatch in impedance, (b) a sharing of power generated by said inherently tuned antenna, (c) inductance, and (d) reflections due to said mismatch of impedance.

42. The method of energy recovery of claim 41, including employing a said circuit which does not require discrete capacitance.

43. The method of energy recovery of claim 41, including employing said tank circuit and said inherent resistance to regenerate said antenna.

44. The method of energy recovery of claim 40, including employing in said antenna an electrically conductive coil having predetermined width, height and conductivity.

45. The method of energy recovery of claim 44, including employing a material of predetermined permitivity disposed adjacent to said conductive coil.

46. The method of energy recovery of claim 44, including employing as said conductive coil a planar antenna, employing a substrate having said conductive coil on a first surface and a ground plane on an opposite surface, and employing as said antenna a circuit having inherent distributed inductance and inherently distributed capacitance forming a tank circuit and inherent distributed resistance to regenerate said antenna.

47. The method of energy recovery of claim 46, including employing at least a substantial portion of said inherent distributed capacitance between said conductive coil and said ground substrate.

48. The method of energy recovery of claim 46, including employing at least a substantial portion of said inherent distributed capacitance between segments of said conductive coil.

49. The method of energy recovery of claim 46, including employing a portion of said inherent distributed capacitance between said conductive coil and said ground substrate and a portion of said inherent distributed capacitance between segments of said conductive coil.

50. The method of energy recovery of claim 40, including employing a mismatch in impedance in said circuit to effect said regenerative feedback.

51. The method of energy recovery of claim 50, including said circuit is structured to provide feedback due to standing wave reflection due to said mismatch in impedance.

52. The method of energy recovery of claim 40, including employing a sharing of power generated by said inherently tuned antenna to effect said regenerative feedback.

53. The method of energy recovery of claim 40, including employing inductance in said circuit to effect said regenerative feedback.

54. The method of energy recovery of claim 40, including employing a stand-alone circuit as said circuit.

55. The method of energy recovery of claim 40, including employing a circuit formed on an integrated circuit electronic chip as said circuit.

56. The method of energy recovery of claim 40, including creating said circuit with an effective antenna area about 1000 to 2000 times the physical area of said antenna.

57. The method of energy recovery of claim 40, including said circuit having inherent distributed resistance which contributes to said feedback.

* * * * *